US006415990B1

(12) United States Patent
Kiplinger

(10) Patent No.: US 6,415,990 B1
(45) Date of Patent: Jul. 9, 2002

(54) METERING DISPENSER FOR POWDER AND GRANULES

(75) Inventor: Dale Vilmer Kiplinger, Carrollton, TX (US)

(73) Assignee: NCH Corporation, Irving, TX (US)

( * ) Notice: Subject to any disclaimer, the term of this patent is extended or adjusted under 35 U.S.C. 154(b) by 68 days.

(21) Appl. No.: 09/658,307

(22) Filed: Sep. 8, 2000

(51) Int. Cl.[7] ..... B05B 3/02
(52) U.S. Cl. ..... 239/215; 239/672
(58) Field of Search ..... 239/215–217, 239/650, 651, 654, 657, 672, 689, 590, 597, 600; 222/401, 402, 456, 195; 406/136–138

(56) References Cited

U.S. PATENT DOCUMENTS

| | | | | |
|---|---|---|---|---|
| 4,225,065 | A | 9/1980 | Brehm | 222/631 |
| 4,399,945 | A | 8/1983 | Ruud | 239/697 |
| 4,553,698 | A | 11/1985 | Parker et al. | 239/3 |
| 4,648,202 | A | 3/1987 | Renth | 43/132.1 |
| 4,742,641 | A | 5/1988 | Cretti | 43/132.1 |
| 4,805,341 | A | 2/1989 | Maeda | 43/132.1 |
| 4,809,462 | A | 3/1989 | Maeda | 43/124 |
| 4,823,505 | A | 4/1989 | Jackson | 43/124 |
| 4,945,673 | A | 8/1990 | Lavelle | 43/124 |
| 4,958,456 | A | 9/1990 | Chaudoin et al. | 43/124 |
| 4,966,330 | A | 10/1990 | Loof | 239/690 |
| 5,027,546 | A | 7/1991 | Tallon | 43/124 |
| 5,058,312 | A | 10/1991 | Jackson | 43/124 |
| 5,083,710 | A | 1/1992 | McLoughlin et al. | 239/690 |
| 5,213,271 | A | 5/1993 | Uribe et al. | 239/654 |
| 5,309,669 | A | 5/1994 | Jackson | 43/124 |
| 5,361,533 | A | 11/1994 | Pepper | 43/124 |
| 5,746,131 | A | 5/1998 | Henn et al. | 101/424.2 |

*Primary Examiner*—Lisa A. Douglas
(74) *Attorney, Agent, or Firm*—Locke Liddell & Sapp LLP; Monty L. Ross

(57) ABSTRACT

A hand-held, pneumatically propelled, metering dispenser for powdered or granular products such as pesticides, the dispenser having a manually operated pneumatic pump, a product canister, a metering scoop insertable into the product canister in operative alignment with the pneumatic pump, and a discharge line into and through which powder or granules supported in the scoop are blown by operation of the pneumatic pump.

36 Claims, 2 Drawing Sheets

METERING DISPENSER FOR POWDER AND GRANULES

BACKGROUND OF THE INVENTION

1. Field of the Invention

This invention relates to pneumatic dispensers for compositions in powder or granular form such as, for example, powdered and granular pesticides. More particularly, the invention relates to a hand-held, metering dispenser that will enable the user to carefully control the amount of powder or granules applied at each use site.

2. Description of Related Art

Insects such as ants, crickets and roaches often travel and dwell in areas that are difficult to access, such as the backs of cabinets, and cracks and crevices in wood and concrete structures. A bait product that is deposited in these areas is more effective than baits placed in areas that are well lighted and generally more accessible because such areas are typically frequented by insects only at night.

It is often desired to put a known amount of powder or granule material in hard-to-reach areas. Holes can be drilled in walls, and powder or granule products can then be blown into the walls through the holes. The powder or granule materials can be dispensed by a variety of hand pumps, many using manual or automated pneumatic delivery systems. Liquids can also be pumped into blind areas using many of such devices, but can do serious damage to drywall if over-applied. Also, it is generally known in the trade that a dry granule bit can remain active for a longer period of time than gels or liquids since the moisture tends to break down the stability of the materials.

The use of hand-held pneumatic sprayers for applying liquid or powder pesticides is well known. One such hand-held powder sprayer is disclosed, for example, in U.S. Pat. No. 4,225,065. Such sprayers typically have a chamber or canister that is first loaded with a quantity of the material to be sprayed. The material is then dispensed by manually reciprocating a pneumatic plunger that forces air through the chamber or canister, entraining some of the material to be dispensed and discharging it through an outlet port or spray nozzle. One disadvantage of the known hand-held devices is the difficulty encountered by the user in monitoring the amount of material being applied at each use site. This can be particularly difficult where the sprayer is used to force powder or granules through a small opening into an enclosed structure, such as a wall, or other blind area where the user cannot physically observe the amount of product being dispensed. Although, with the prior art devices, the amount of material dispensed is generally proportional to the number of times the plunger is reciprocated, a device is needed that will enable the user to more reliably monitor the amount dispensed. This is particularly important where the sprayer is used commercially, where the material being sprayed is relatively expensive, and where over-spraying produces no corresponding resultant improvement.

A hand-held powder sprayer is therefore needed that is inexpensive and easy to use, but that preferably includes a simple and reliable, internal metering device that can be used to control the amount of powder being dispensed through the sprayer.

Other prior art pneumatic and aerosol-powered pesticide dusters useful for dispensing powders into wall structures or other blind areas are disclosed, for example, in U.S. Pat. Nos. 4,553,698; 4,648,202; 4,823,505; 5,058,312; 5,309,669 and 5,361,533.

Powder sprayers with pneumatic powder supply systems preferred for use with printing presses are disclosed, for example, in U.S. Pat. Nos. 5,083,710, 5,213,271 and 5,746,131. Powder sprayers using electrostatic charging technology are disclosed, for example, in U.S. Pat. Nos. 4,399,945 and U.S. Pat. No. 4,966,330.

SUMMARY OF THE INVENTION

According to a preferred embodiment of the invention, a hand-held, pneumatic metering dispenser is provided that is useful for propelling predetermined quantities of particulate materials such as powder and granules from a canister, through a discharge conduit and toward a target. The apparatus of the invention is particularly useful for spraying known quantities of powdered and granulated pesticide products into walls or other blind structures or locations.

The preferred apparatus of the invention is a hand-held applicator for powder and granules comprising a pneumatic pump, a product canister and a metering scoop insertable into the canister that communicates with a product discharge tube. Once a supply of powder or granular material is loaded into the canister and the metering scoop is installed, a predetermined quantity of the powder or granules is loaded into the scoop simply by rotating the applicator 360° around its longitudinal axis. The filled metering scoop is most preferably positioned inside the canister in an upwardly facing position near the top of the cylindrical sidewall. When pressurized air is expelled into the canister from the pneumatic pump, the increased pressure inside the canister forces the predetermined quantity of powder or granular material from the scoop through an orifice disposed in its bottom wall, and into and through the discharge line of the applicator.

The apparatus of the invention can be marketed and used as a new device or as a modification to existing "off-the-shelf" sprayers by simply replacing the original discharge assembly. This invention can be also be used in an application where one product is need to be measured and dispensed along with a lighter or heavier weight product, although it is believed that most of the more common applications will involve dispensing a dry product in a stream of air.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1:
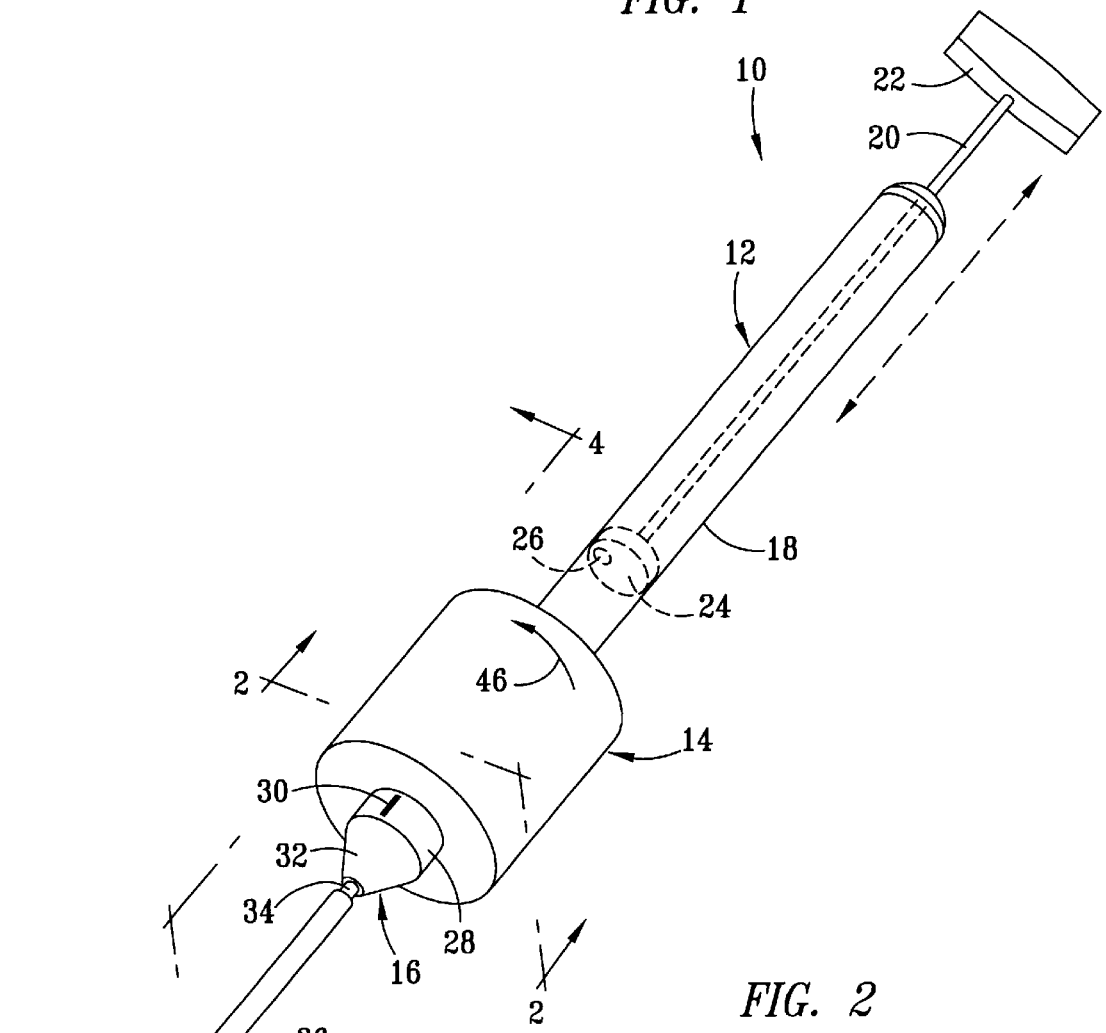
FIG. 1 is a perspective view of a preferred embodiment of the metering dispenser of the invention.

Referring to FIGS. 1–4, metering dispenser 10 of the invention preferably comprises pneumatic pump assembly 12, canister assembly 14 and discharge assembly 16. Pneumatic pump assembly 12 preferably further comprises elongated cylinder 18 having rod 20 and plunger 24 slidably insertable therein. Handle 22 is manipulated by the user to reciprocate rod 20 and plunger 24 inside cylinder 18 to force air into canister assembly 14 as discussed below. Orifice 26 as shown in FIG. 1 is preferably a conventional check valve of the type used in pneumatic sprayers and bicycle air pumps.

Figure 4:
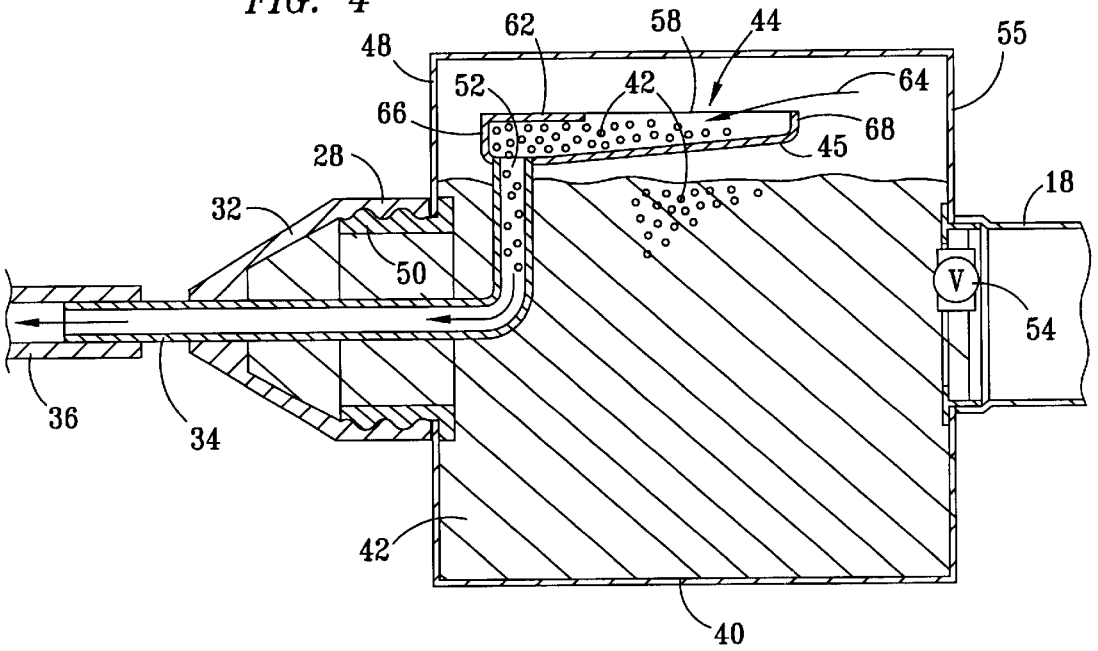
FIG. 4 is an enlarged cross-sectional view taken along line 4—4 of FIG. 1.

Referring to FIGS. 1 and 4, canister assembly 14 preferably comprises a cylindrical canister 40 that is attachable in coaxial alignment with pneumatic pump assembly 12, end wall 48 having opening 47 with externally threaded collar 50, and valve 54 in end wall 55. Referring to FIG. 4, valve 54 is preferably disposed in end wall 55 of canister 40 adjacent to cylinder 18 so that air compressed by the forward movement of reciprocating plunger 24 of pump assembly 12 as seen in FIG. 1 is forced into the interior of canister 40. Cylinder 18, valve 54 and canister 40 are preferably attached in fixed relation to each other by any suitable means such as, for example, by the use of threads, by welding, brazing, or the like. End wall 48 of canister 40 preferably comprises opening 47 that is large enough to facilitate loading powder or granular material into canister 40 prior to use. Annular collar 50, preferably having external threads, is provided for use in releasably attaching discharge assembly 16 to canister assembly 14.

Discharge assembly 16 preferably comprises discharge tube 34, internally threaded coupling 28 having a forwardly extending conical portion 32 attached in fixed relation to discharge tube 34, metering scoop 44 attached in fixed relation to discharge tube 34, and tubular extension member 36 having open end 38 for discharging powder from dispenser 10. The portion of discharge tube 34 passing through conical portion 32 of coupling 28 is preferably coaxially aligned with pump rod 20. Tubular extension member 36 can be made of metal, plastic or other polymeric material as desired.

Figure 2:
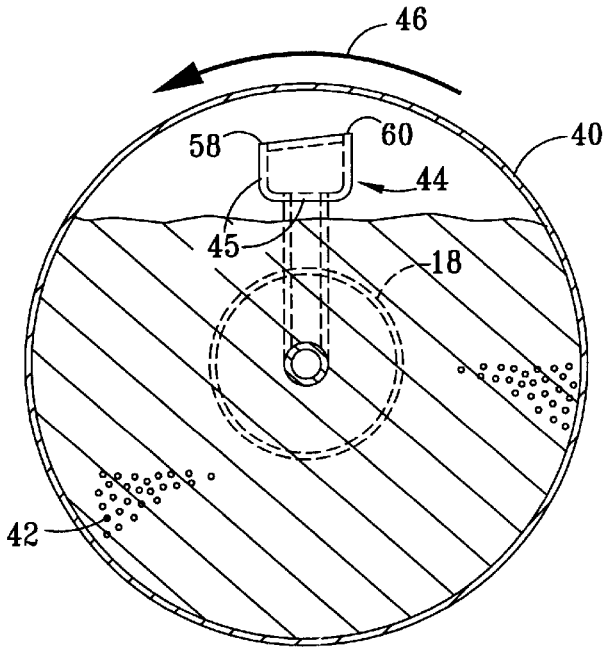
FIG. 2 is an enlarged cross-sectional view taken along line 2—2 of FIG. 1.
Figure 3:
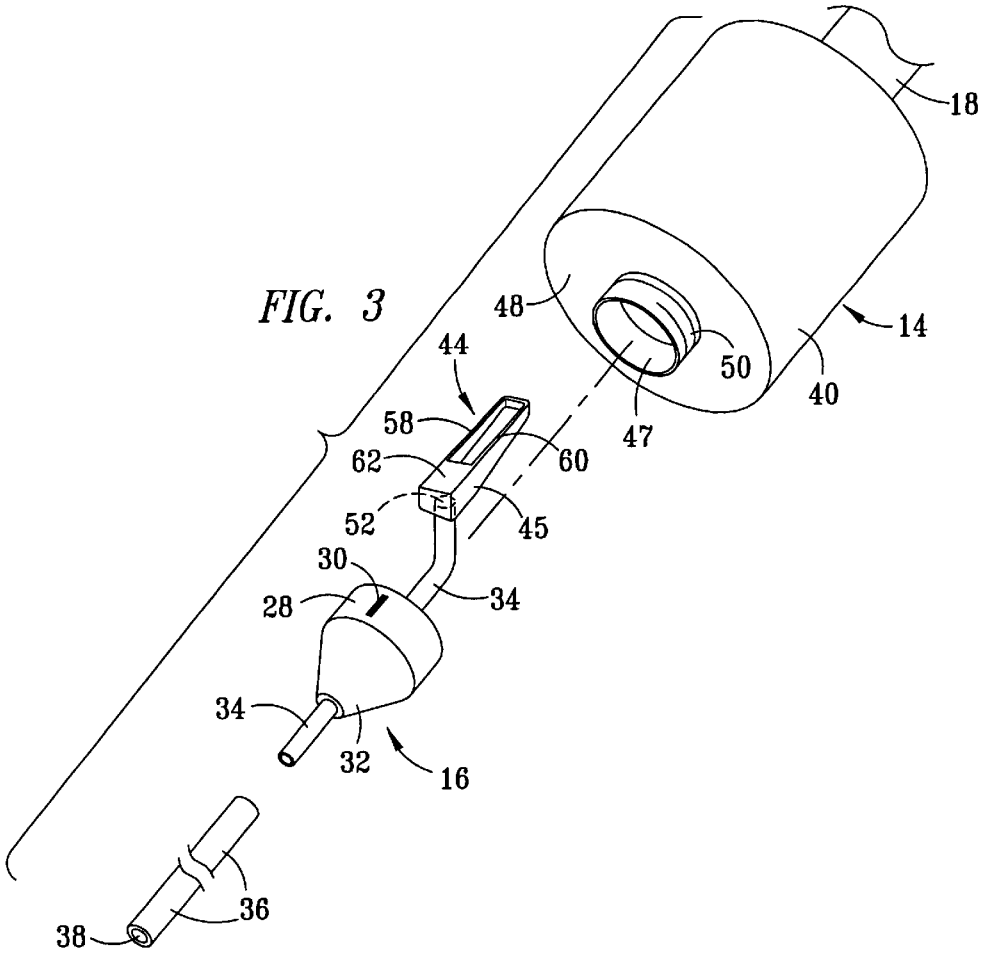
FIG. 3 is an exploded perspective view of the forward portion of the metering dispenser of FIG. 1, showing the metering scoop and discharge conduit prior to assembly with the canister.

Referring to FIGS. 2–4, metering scoop 44 is preferably made of metal or plastic in the shape of a tapered trough comprising proximal and distal end walls 66, 68, respectively, connected to U-shaped bottom and side wall 45. The bottom portion of wall 45 is preferably upwardly tapered between proximal end wall 66 and distal end wall 68. For reasons explained in greater detail below, leading side edge 58 of wall 45 is slightly lower than trailing side edge 60. The top of metering scoop 44 is open over most of its length, except for a covered section 62 disposed over outlet port 52, located in the bottom of wall 45 adjacent proximal end wall 66, where discharge tube 34 is connected to scoop 44. Covered section 62 prevents powder that is lifted or entrained by the air flow from being carried over the walls of scoop 44 and falling back into canister 40. Covered section 62 preferably does not cover more than about one third the length of scoop 44 and, most preferably, from about one fourth to about one third the length of scoop 44. Discharge tube 34 is desirably formed with an outwardly turned bend or curvature at the end, and is attached to metering scoop 44 so as to provide an open flow path between the interior of scoop 44 and the interior of discharge tube 34 through orifice 52. Because discharge tube 34 is desirably curved or bent, metering scoop 44 is offset from, but still substantially parallel to, the central longitudinal axis extending through canister 40. It should be appreciated that FIGS. 2 and 4 are not drawn to scale, and according to a particularly preferred embodiment of the invention, the radial clearance between scoop 44 and canister 14 ranges from about one-eighth to about one-half inch, and most preferably, from about one-eighth to about one-fourth inch.

The size of metering scoop 44, the shape and diameter of discharge tube 34 and the diameter of opening 47 are all cooperatively sized to permit the insertion of scoop 44 through opening 47 into canister 40 during assembly of dispenser 10. The diameter of orifice 52 and the inside diameter of discharge tube 34 are preferably sufficiently large that they will freely accommodate the passage of the powder or granular material through them, yet small enough that the pressure exerted will be sufficient to propel the powder or granules from scoop 44, into and through discharge tube 34 and optional extension member 36. According to a particularly preferred embodiment of the invention, the exterior of dispenser 10 will bear a label at some location that informs the user as to the internal volume of metering scoop 44.

Referring to FIGS. 1, 2 and 3, coupling 28 of discharge assembly 16 is preferably made with an outwardly visible index mark 30 located at the position on the circumference of coupling 28 that indicates the position of metering scoop 44 relative to coupling 28 whenever metering scoop 44 is inserted into canister 40 and coupling 28 is threaded onto collar 50. When dispenser 10 is assembled with coupling 28 fully threaded onto collar 50 of canister assembly 14, and index mark 30 is facing upwards (FIG. 1), the user will know that metering scoop 44 is in the "12 o'clock" position, with its open top facing upwardly. This feature of the invention, or the substitution of another similarly effective indicator, is significant so that the user will know when metering scoop 44 is "loaded" with powder or granules and ready for the application of pneumatic pressure to canister 40.

Use of the invention is further described and explained in relation to FIGS. 1–4. Prior to attachment of discharge assembly 16 to canister assembly 14, a quantity of the powder or granular material to be dispensed is poured into canister 40 through opening 47. Preferably, canister 40 is filled not more than about three-fourths full. Coupling 28 is then threaded snugly onto collar 50, following which metering dispenser 10 is ready for use. To operate dispenser 10, the user grasps the unit and rotates it in either direction around its longitudinal axis until index mark 30 is facing upwardly, in which position metering scoop 44 is also facing upwardly. The user then rotates the dispenser around its longitudinal axis in the direction shown by arrow 46 in FIGS. 1 and 2 until mark 30 again appears on top of coupling 28.

As dispenser 10 is rotated in the counter-clockwise direction demonstrated by arrow 46, the offset of scoop 44 relative to the central longitudinal axis of dispenser 10 causes metering scoop 44 to sweep through the bed of powder or granules contained in canister 40, which remain in the lower portion of canister 40 as it is rotated. As metering scoop 44 is rotated through the bed of powder or granules 42, the height differential between leading edge 58 and trailing edge 60 causes scoop 44 to fill. The slightly higher trailing edge 60 of metering scoop 44 also causes it to retain the powder or granular material 42 as scoop 44 emerges from the bed of loose powder and rotates upwardly to a vertical position. When scoop 44 is loaded and at the position shown in FIGS. 2 and 4, it is filled with powder or granules 42. As the user reciprocates handle 22, rod 20 and plunger 24 inside cylinder 18, while maintaining dispenser 10 in substantially the same rotational alignment, air blown into canister 40 through valve 54 pressurizes the interior of canister 40 to a level sufficient to apply a force as indicated, for example, by arrow 64 (FIG. 4) to cause powder or granular material 42 inside metering scoop 44 to descend through orifice 52 and into and through discharge line 34.

The powder or granules 42 are then discharged under pressure through open end 38 of extension member 36 (or directly from discharge tube 34 if no extension member 36 is used).

Depending upon the volume and pressure of the air forced into canister 40 from pump assembly 12, and depending upon the volume and density of the powder or granules 42 being dispensed, more than one pump stroke may be necessary to apply the total amount of product in metering scoop 44. Provided, however, that dispenser 10 is neither shaken nor rotated again so that metering scoop 44 travels through the underlying bed of powder or granules 42, the user will know the volume of powder or granules 42 dispensed. When the amount of powder or granules 42 inside canister 40 is such that the surface level inside canister 40 is above valve 54, air expelled into canister 40 through valve 54 will still migrate upwardly through the powder or granules, pressurizing the interior of canister 40 sufficiently to cause powder or granules 42 to flow from scoop 44 into discharge line 34. Because of the proximity of the open top of metering scoop 44 to the cylindrical side wall of canister 40 during use of dispenser 10 to apply powder or granules 42, no appreciable amount of powder or granules will be entrained and carried up from the bed into metering scoop 44 by the air flow inside canister 40.

Although the size and shape of metering scoop 44 can vary, the volume of powder or granules that the scoop can hold should not exceed the smallest amount that the user is likely to want dispensed at a particular location. A metering scoop 44 having a volume sufficient to hold from about 3 to about 5 grams of a particulate pesticide is preferred, although it will be appreciated that the weight of the material that can be supported inside scoop 44 will necessarily vary according to the density of the material. If desired, discharge assemblies 16 having metering scoops 44 with different volumes can be provided for use with various powdered or granular materials. Alternatively, discharge assemblies 16 can be made in such manner that metering scoops 44 of different volumes can be selectively attached to discharge tube 34 in order to accommodate different materials as desired.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. A hand-held dispenser for powdered or granular particulate material, the dispenser comprising:

a pneumatic pump assembly having a cylinder, a reciprocating plunger for selectively pressurizing air inside the cylinder, and a discharge port through which pressurized air is discharged from the cylinder;

a canister assembly having a substantially cylindrical canister with an interior, a first port through which particulate material is introducible into the interior, a second port through which pressurized air is introducible into the interior from the pneumatic pump assembly, and a valve disposed adjacent to the second port; and a discharge assembly having a discharge tube attachable to the canister and a metering scoop insertable into the canister interior in fixed relation to the canister, the metering scoop having a known volume and further comprising an outlet orifice communicating with the discharge tube.

2. The dispenser of claim 1 wherein the discharge assembly is attachable to the canister by means of a releasably threaded coupling secured in fixed relation to the discharge tube.

3. The dispenser of claim 2 wherein the coupling further comprises an outwardly visible index mark signifying the position of the metering scoop relative to the canister when the discharge assembly is attached to the canister.

4. A hand-held dispenser for powdered or granular particulate material, the dispenser comprising:

a pneumatic pump assembly having a cylinder, a reciprocating plunger for selectively pressurizing air inside the cylinder, and a discharge port through which pressurized air is discharged from the cylinder;

a canister assembly having a substantially cylindrical canister with an interior, a first port through which particulate material is introducible into the interior, a second port through which pressurized air is introducible into the interior from the pneumatic pump assembly, and a valve disposed adjacent to the second port; and a discharge assembly having a discharge tube attachable to the canister and a metering scoop insertable into the canister interior in fixed relation to the canister, the metering scoop having a known volume and further comprising an outlet orifice communicating with the discharge tube;

the metering scoop also having proximal and distal ends, and an upwardly tapered bottom wall extending between the proximal and distal ends, and the outlet orifice being disposed in the bottom wall adjacent the proximal end.

5. A hand-held dispenser for powdered or granular particulate material, the dispenser comprising:

a pneumatic pump assembly having a cylinder, a reciprocating plunger for selectively pressurizing air inside the cylinder, and a discharge port through which pressurized air is discharged from the cylinder;

a canister assembly having a substantially cylindrical canister with an interior, a first port through which particulate material is introducible into the interior, a second port through which pressurized air is introducible into the interior from the pneumatic pump assembly, and a valve disposed adjacent to the second port; and a discharge assembly having a discharge tube attachable to the canister and a metering scoop insertable into the canister interior in fixed relation to the canister, the metering scoop having a known volume and further comprising an outlet orifice communicating with the discharge tube;

the metering scoop further comprising first and second longitudinally extending side wall sections, the first side wall section terminating in a leading edge and the second side wall section terminating in a trailing edge, the leading edge being lower than the trailing edge when the metering scoop is upwardly directed.

6. The dispenser of claim 1 wherein the metering scoop has a covered top portion disposed at an end of the metering scoop adjacent to the outlet orifice.

7. The dispenser of claim 1 wherein the metering scoop is insertable into the canister through the first port.

8. The dispenser of claim 1 wherein the valve is a check valve.

9. The dispenser of claim 1 wherein the second port is disposed in the valve.

10. The dispenser of claim 1 wherein the cylinder is connected in fixed relation to the canister.

11. The dispenser of claim 1 wherein the outlet orifice defines a flow path for the particulate material from the metering scoop into the discharge tube.

12. The dispenser of claim 1 wherein the canister has a longitudinal axis and the metering scoop is substantially parallel to but spaced apart from the longitudinal axis.

13. The dispenser of claim 12 wherein the discharge tube curves radially outward between the longitudinal axis of the canister and the metering scoop.

14. The dispenser of claim 1, further comprising an extension tube attachable to the discharge tube.

15. The dispenser of claim 4 wherein the discharge assembly is attachable to the canister by means of a releasably threaded coupling secured in fixed relation to the discharge tube.

16. The dispenser of claim 15 wherein the coupling further comprises an outwardly visible index mark signifying the position of the metering scoop relative to the canister when the discharge assembly is attached to the canister.

17. The dispenser of claim 4 wherein the metering scoop has a covered top portion disposed at an end of the metering scoop adjacent to the outlet orifice.

18. The dispenser of claim 4 wherein the metering scoop is insertable into the canister through the first port.

19. The dispenser of claim 4 wherein the valve is a check valve.

20. The dispenser of claim 4 wherein the second port is disposed in the valve.

21. The dispenser of claim 4 wherein the cylinder is connected in fixed relation to the canister.

22. The dispenser of claim 4 wherein the outlet orifice defines a flow path for the particulate material from the metering scoop into the discharge tube.

23. The dispenser of claim 4 wherein the canister has a longitudinal axis and the metering scoop is substantially parallel to but spaced apart from the longitudinal axis.

24. The dispenser of claim 23 wherein the discharge tube curves radially outward between the longitudinal axis of the canister and the metering scoop.

25. The dispenser of claim 4, further comprising an extension tube attachable to the discharge tube.

26. The dispenser of claim 5 wherein the discharge assembly is attachable to the canister by means of a releasably threaded coupling secured in fixed relation to the discharge tube.

27. The dispenser of claim 26 wherein the coupling further comprises an outwardly visible index mark signifying the position of the metering scoop relative to the canister when the discharge assembly is attached to the canister.

28. The dispenser of claim 5 wherein the metering scoop has a covered top portion disposed at an end of the metering scoop adjacent to the outlet orifice.

29. The dispenser of claim 5 wherein the metering scoop is insertable into the canister through the first port.

30. The dispenser of claim 5 wherein the valve is a check valve.

31. The dispenser of claim 5 wherein the second port is disposed in the valve.

32. The dispenser of claim 5 wherein the cylinder is connected in fixed relation to the canister.

33. The dispenser of claim 5 wherein the outlet orifice defines a flow path for the particulate material from the metering scoop into the discharge tube.

34. The dispenser of claim 5 wherein the canister has a longitudinal axis and the metering scoop is substantially parallel to but spaced apart from the longitudinal axis.

35. The dispenser of claim 34 wherein the discharge tube curves radially outward between the longitudinal axis of the canister and the metering scoop.

36. The dispenser of claim 5, further comprising an extension tube attachable to the discharge tube.

* * * * *